US005111165A

United States Patent [19]

Oldfield

[11] Patent Number: 5,111,165

[45] Date of Patent: May 5, 1992

[54] MICROWAVE COUPLER AND METHOD OF OPERATING SAME UTILIZING FORWARD COUPLING

[75] Inventor: William W. Oldfield, Redwood City, Calif.

[73] Assignee: Wiltron Company, Morgan Hill, Calif.

[21] Appl. No.: 378,012

[22] Filed: Jul. 11, 1989

[51] Int. Cl.[5] ..... H01P 5/18

[52] U.S. Cl. ..... 333/116; 333/109; 333/115

[58] Field of Search ..... 333/109, 115, 116

[56] References Cited

U.S. PATENT DOCUMENTS

| | | | |
|---|---|---|---|
| 2,721,309 | 10/1955 | Seidel | 333/116 |
| 2,792,550 | 5/1957 | Backstrand | 333/115 |
| 3,012,210 | 12/1961 | Nigg | 333/116 |
| 3,204,206 | 8/1965 | Harmon | 333/116 |
| 3,621,478 | 11/1971 | Johnson | 333/116 |
| 3,980,972 | 9/1976 | Podell | 333/116 |
| 4,376,921 | 3/1983 | Dickens et al. | 333/116 |
| 4,459,568 | 7/1984 | Landt | 333/116 |
| 4,502,028 | 2/1985 | Leake | 333/109 |
| 4,571,545 | 2/1986 | Griffin et al. | 333/109 X |

FOREIGN PATENT DOCUMENTS

| | | | |
|---|---|---|---|
| 114302 | 5/1987 | Japan | 333/116 |

*Primary Examiner*—Eugene R. LaRoche
*Assistant Examiner*—Benny Lee
*Attorney, Agent, or Firm*—Fliesler, Dubb, Meyer & Lovejoy

[57] ABSTRACT

A suspended substrate coupler for operation at frequencies of 26 GHz or higher operated in a forward coupling mode. Coupling tends to improve with increased frequency and coupling as tight as 2 dB is provided for frequencies of 40 to 60 GHz. The first and second coupled lines are suspended striplines provided on both surfaces of a dielectric supported between two parallel ground planes. The spacing between the coupled striplines is approximately an order of magnitude greater than the spacing between the coupled lines of a conventional contra-directional coupler, and the length of the coupled sections of the striplines is not required to be a multiple of a quarter wavelength.

19 Claims, 4 Drawing Sheets

MICROWAVE COUPLER AND METHOD OF OPERATING SAME UTILIZING FORWARD COUPLING

BACKGROUND OF THE INVENTION

1. Field of the Invention

The present invention relates to directional couplers, and more particularly to couplers for microwave applications.

2. Description of the Related Art

Arrays of parallel, coupled lines have two general areas of application in microwave circuits: (a) directional couplers; and (b) filters, delay lines, and matching networks. Directional couplers couple a prescribed amount of power input on a first transmission line to an second (or coupled) transmission line. For example, a 3dB coupler couples one-half of the power transmitted by a first transmission line to a second transmission line—the ratio of the power input to the first transmission line to the power coupled to the second transmission line is usually expressed in dB with increased coupling being represented by a smaller coupling value in dB. Power input on the second transmission line is also coupled to the first transmission line. Directional couplers are useful measurement tools which provide a simple, convenient, and accurate means for sampling microwave energy.

FIG. 1 illustrates the basic construction of a conventional coupled-line directional coupler 10 useful in, for example, microwave applications. Directional coupler 10 includes first and second parallel striplines 12, 14 coupled over multiples of approximately one-quarter wavelength ($\lambda/4$). Ports A and B are provided at first and second ends 16, 18 of first stripline 12 and ports C and D are provided at first and second ends 20, 22 of second stripline !4. The designation stripline, as used herein, refers to any conductor which has infinite ground planes on both sides of the conductor, including, for example, striplines, suspended striplines, and triplate striplines. The conductor itself may have different shapes, e.g., round or rectangular.

Ports A and B which are located at the first and second ends 16 and 18, respectively, of the first stripline 12 and ports C and D which are located at the first and second ends 20 and 22, respectively of the second stripline 14 will alternatively be referred to using the alphabetic port identifier or the following designations. An "input port" is any port to which a signal is applied. A stripline which has an input port is the "through stripline" and the other stripline is the "coupled stripline." With reference to an input port, a "through port" is at the opposite end of the through stripline from the input port, an "adjacent port" is at the same end of the coupled stripline as the input port, and an "opposite port" is at the opposite end of the coupled stripline from the input port. If a coupler has multiple inputs, and thus more than one input port, more than one designation may apply to a single port. In the coupler shown in FIG. 1, if port A is the input port, port B is the through port, port C is the adjacent port, and port D is the opposite port.

The first and second parallel striplines 12, 14, the through and coupled striplines, respectively, have a specified, small spacing in a coupling region 26. Ports A-C are usually configured for connection to coaxial transmission lines and the outer conductor or ground for each coaxial line is connected to grounded body 28 of coupler 10. Port D terminates the second stripline 14 by interconnecting stripline 14 to the body 28 of coupler 10, which is at ground potential, through resistor 30.

Conventional TEM or quasi-TEM mode directional couplers provide contra-directional coupling. In contra-directional coupling, energy applied to a first stripline at an input port is directionally coupled from the first stripline to the coupled stripline and appears at the adjacent port on the coupled stripline, with a greater amount of power appearing at the adjacent port than the opposite port. For example, energy applied at port A of the first stripline 12 appears at port B of first stripline 12; however, some fraction of the energy will appear at port C of the second stripline 14. The amount of energy appearing at port C of second line 14 depends upon the amount of coupling provided in the design of the coupler. Several factors, including the spacing between the striplines 12, 14, determine the amount of energy that may be transferred from the one line to the other.

The amount of coupling desired for forward power (power flowing in the port A-to-port-B direction) varies with the application. For example, a coupler used to split a signal would use tight coupling, i.e., a large amount of power would be coupled to the coupled stripline. Coupling values of 30dB to 3dB are typically encountered in practice, and coupling of 8dB or better (i.e., coupling values of 8dB to 0dB) is generally referred to as tight coupling.

The directivity of a coupler is calculated as the ratio of the power coupled to the adjacent port to the power coupled to the opposite port, expressed in dB. For example, directivity is an indication of the amount of power appearing at port D, as a fraction of the power appearing at port C, when power is applied at port A, and is a measure of the isolation between port A and port D. It is generally desirable to avoid the loss of power, and thus the ideal directional coupler will have an infinite value of directivity. Values of directivity usually range from 5dB to 30dB.

Directional couplers are useful devices for measuring reflected energy. This is accomplished by applying energy to port B and connecting a device under test at port A. Energy reflected by the device under test will flow in the port A-to-port-B direction and a known fraction thereof will appear at port C.

A conventional 3dB, TEM, air dielectric, stripline coupler comprising a first and a second stripline 36 and 38, respectively, is shown in the schematic diagram of FIG. 2A and in the cross sectional view of FIG. 2B. The first and second striplines 36, 38 are provided between first and second ground planes 40, 42 and are surrounded by an air dielectric. The stripline 36 comprises a pair of end sections **36*a* and a center section 36*b*. The stripline 38 comprises a pair of end sections 38*a* and a center section 38*b*. The center sections 36*b* and 38*b* are in parallel and spaced a distance $S_1$ apart. The spacing d between the ground planes 40, 42 is approximately 0.045". In coupling region 39 each stripline 36, 38 has a thickness t of 0.006" and a width w of 0.020", and the spacing $S_1$ between the striplines 36, 38 is 0.0025". At the frequencies at which a conventional contra-directional coupler is operated the dimensions of the coupler, except for the length of the coupled sections of striplines 36, 38**, generally do not vary with frequency.

Each of the dimensions of a coupler affects performance; for the purpose of providing tight coupling, the stripline spacing $S_1$ is one of the important factors. For conventional TEM mode and quasi-TEM mode coupling, tight coupling requires (i) a spacing $S_1$ on the order of thousandths of an inch with tolerances of ten-thousandths of an inch, and (ii) high impedance striplines in the coupled region (high impedance striplines are provided by selecting the dimensions of the striplines in the coupled region). In general, for TEM mode and quasi-TEM mode coupling the even mode impedance of the coupled sections of the striplines is approximately 120Ω for a 3B coupler, an increase of more than a factor of two (2) with respect to the 50Ω impedance of the remaining portions of the striplines and the first and second transmission lines.

Coupled striplines 12, 14 of some conventional directional couplers are constructed using metalized plastic layers similar to multi-layer printed circuit board. The metal is etched to form a desired conductor or circuit pattern. One type of coupler fabricated in this manner is a suspended substrate coupler in which the coupled striplines are suspended microstrips. A suspended coupler which operates as a quasi—TEM coupler is disclosed in Japanese Laid Open Application No. 62-114302—Miyazaki.

Very small, high-frequency geometries can be formed with suspended substrate couplers. However, until approximately 1984, it was believed that the maximum frequency which could be handled by coaxial couplers was 26GHz. This perceived limitation was related, at least in part, to the inability to manufacture components such as couplers with the small dimensions and tolerances required for frequencies above 26GHz. Tolerances on the order of approximately 0.0005" must be maintained for frequencies over 26GHz. Further, it has not been possible to make a coupler which provides coupling tighter than 3dB with conventional suspended substrate couplers.

At higher microwave frequencies (above 20GHz), suspended substrate couplers offer low loss, relatively large size features, and precise impedance control. For frequencies above 26GHz, the transmission lines must comprise microstrips provided on both sides of the suspended substrate because single sided transmission lines suffer from dielectric surface modes.

The directivity of contra-directional suspended substrate couplers is, in general, very poor for frequencies below 20GHz (directivity values usually range from 5 to 15dB). At frequencies above 20 GHz the directivity of a suspended substrate contra-directional coupler rapidly degrades further. In addition, conventional suspended substrate couplers suffer from losses due to, for example, line resistances and losses in the dielectric. At high frequencies these losses are more critical because losses generally occur per wavelength—the shorter wavelengths associated with higher frequencies result in more loss per length of transmission line. One cause of losses in conventional suspended substrate contra-directional couplers is the need to provide the transmission lines with an increased impedance—on the order of 120Ω for a 3dB coupler—in the coupling region in order to provide tight coupling.

SUMMARY OF THE INVENTION

It is, therefore, an object of the present invention to provide a coupler useful with microwave signals having frequencies of 26GHz and higher.

A further object of the present invention is to provide a coupler which is useful at frequencies ranging from 40 to 60 GHz and beyond.

Another object of the present invention is to provide a directional coupler which operates at frequencies above 26GHz with low losses.

Another object of the present invention is to provide a directional coupler which provides tight coupling (a coupling factor of better than 8dB) and coupling tighter than 3dB.

Another object of the present invention is to provide a coupler in which performance is not effected by differing propagation velocities of odd and even mode signals.

These and other objects of the present invention are provided by a suspended substrate coupler which has a large spacing S (approximately an order of magnitude greater than the spacing for conventional couplers) between the coupled striplines and which is operated in the forward coupling mode. In the forward coupling mode a signal applied to the through stripline at the input port (port A) is coupled to the coupled stripline and appears at the opposite port (port D), with more power appearing at the opposite port than at the adjacent port. Tight forward coupling begins at frequencies of approximately 26GHz and coupling as tight as 1dB for signals of 40–60GHz, with directivity better than 10dB, is provided by such a coupler. In the suspended substrate coupler of the present invention, the first and second transmission lines are suspended striplines spaced apart by a distance which is approximately an order of magnitude larger than the distance between the striplines in a conventional contra-directional couplers. Further, tight coupling is provided by transmission lines constructed to have a uniform impedance of 50Ω, and therefore the need to use higher impedance transmission lines in the coupling region is eliminated.

An apparatus for coupling signals in accordance with the present invention, comprises: first and second transmission lines; means for providing signals having a frequency of approximately 26GHz or greater on said first transmission line; and a suspended substrate coupler for forward coupling said signals from said first transmission line to said second transmission line.

In accordance with the present invention, a method of operating a suspended substrate coupler to couple microwave signals in the forward direction, the coupler comprises first and second transmission lines, the opposite ends of the first transmission line being designated as ports A and B, respectively, and the opposite ends of the second transmission lines being designated as ports C and D, respectively, ports A and C being at corresponding ends of the first and second transmission lines, comprises the steps of: (a) applying a microwave signal having a frequency equal to or greater that 26GHz to port A; and (b) detecting power at ports B and D, where the amount of power detected at port D is at least approximately equal to the amount of power detected at port B.

DESCRIPTION OF THE PREFERRED EMBODIMENTS

A directional coupler in accordance with the present invention will be described with reference to FIGS. 3-7. The inventor of the directional coupler of the present invention has discovered that a suspended substrate coupler having a large spacing between the coupled striplines has improved coupling characteristics for signals of approximately 26GHz or greater when operated in the forward coupling mode. In particular, signals of 40 to 60 GHz are forward coupled with an unusually large amount of power being coupled, with good directivity, and with low losses.

The forward coupling mode, as used herein, refers to the coupling of power from a signal input at an input port (e.g., port A) on a through stripline to the opposite port (e.g., port D) of the coupled stripline. Alternatively, if port B is the input port power is coupled to port C, if port C is the input port power is coupled to port B, or if port D is the input port power is coupled to port A. A forward coupler in accordance with the present invention is useful, with improved results, in many of the same applications where conventional contra-directional couplers are used, provided that the appropriate connections and isolation of the ports of the coupler are established.

Figure 1:
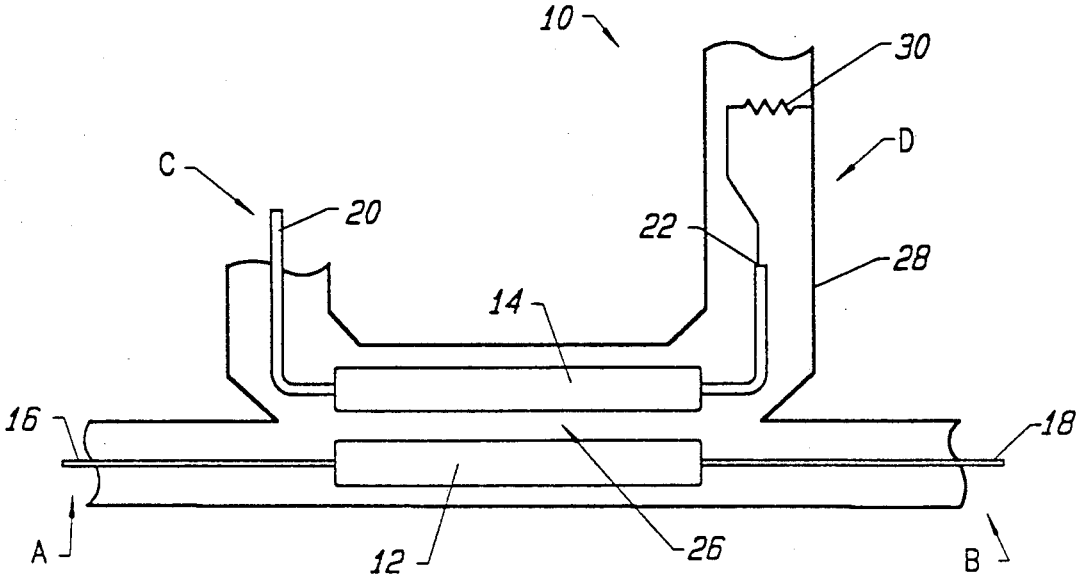
FIG. 1 (PRIOR ART)
FIG. 1 is a plan view of a conventional directional coupler.
Figure 2A:
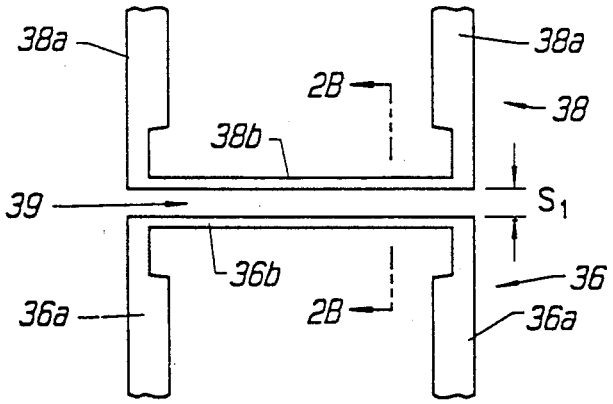
FIG. 2A (PRIOR ART)
FIG. 2A is a schematic diagram of a conventional, air dielectric, TEM mode, stripline, 3dB directional coupler.
Figure 2B:
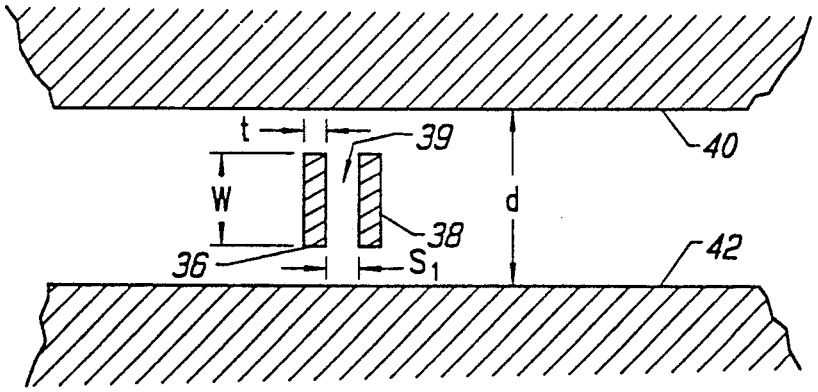
FIG. 2B (PRIOR ART)
FIG. 2B is a sectional view along line 2B—2B in FIG. 2A.
Figure 3:
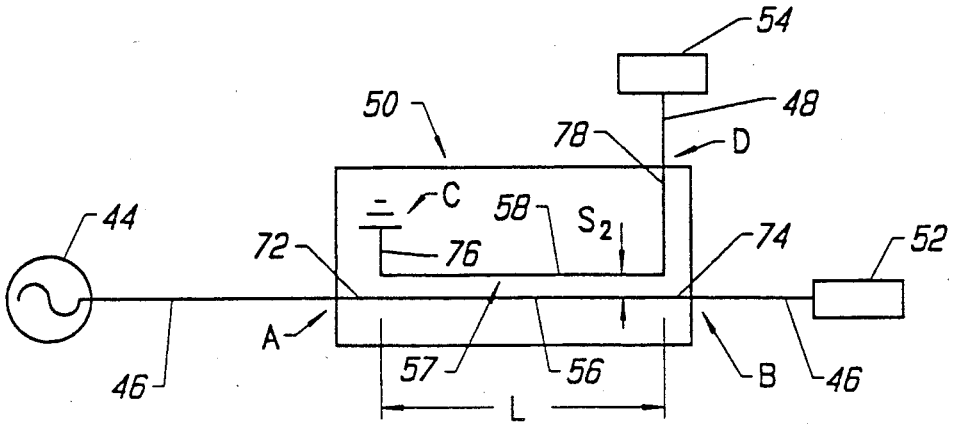
FIG. 3 is a schematic diagram of an apparatus for coupling signals including a suspended substrate directional coupler in accordance with the present invention.

The operation of a suspended substrate coupler in accordance with the present invention will be described with reference to FIG. 3. Signal source 44 provides microwave signals having frequencies of 26 GHz and higher to a first transmission line 46. First transmission line 46 and a second transmission line 48 are connected to coupler 50, and test/measurement devices 52, 54 are connected to transmission lines 46, 48, respectively. Coupler 50 includes first and second stripline conductors 56, 58 which are coupled in coupling region 57, first stripline 56 being inserted as a portion of first transmission line 46, and second stripline conductor 58 being inserted as a portion of second transmission line 48. Coupling region 57 has a length L, and first and second striplines 56, 58 have a spacing $S_2$ in the coupled region. Thus, signal source 44 is connected to port A (first end 72 of stripline 56), test/measurement device 52 is electrically connected to port B (second end 74 of stripline 56), and test/measurement device 54 is electrically connected to port D (second end 78 of stripline 58). Port C (first end 76 of stripline 58) is connected to ground in the embodiment illustrated in FIG. 3.

In operation, signal source 44 supplies signals at port A, and a portion of the power input at port A is transmitted by first stripline 56 to port B. In addition, a portion of the power input at port A is coupled from first stripline 56 to second stripline 58. The coupled power appears at port D. A small amount of power also appears at port C; however, coupler 50 has good directivity and the amount of power appearing at port C is negligible, or at least less than the amount of power appearing at port D.

Figure 4:
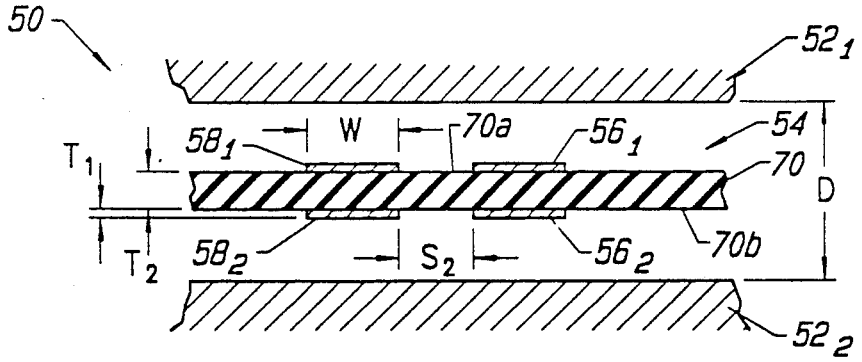
FIG. 4 is a sectional view a suspended substrate directional coupler in accordance with the present invention.

As shown in FIG. 4, a suspended substrate directional coupler 50 in accordance with the present invention includes first and second ground conductive planes $52_1$, $52_2$ and a suspended substrate 70 provided between the ground planes $52_1$, $52_2$. The suspended substrate is a dielectric, for example, alumina. Other dielectrics and the properties of various dielectrics are set forth in "Foundations for Microstrip Circuit Design", T. C. Edwards, John Wiley and Sons, 1981. First and second stripline 56, 58 are provided on the suspended substrate 70, and are each formed of first and second conductors ($56_1$,$56_2$) and ($58_1$,$58_2$), respectively provided on opposed first and second 70*a*,70*b* of suspended substrate 70.

First and second transmission lines 46, 48 (FIG. 3) are usually coaxial conductors. The ground shields of transmission lines 46, 48 are electrically connected to the first and second ground planes $52_1$,$52_2$ of coupler 50, and the centerline conductors of first and second transmission lines 46, 48 are connected to first and second striplines 56, 58, respectively. First and second conductors $56_1$, $56_2$, $58_1$, $58_2$ of each of the first and second striplines 56, 58 are both connected to the centerline conductor of the respective first and second transmission lines 46, 48, so that striplines $56_1$, $56_2$ are connected in parallel and so that striplines $58_1$, $58_2$ are connected in parallel.

Each of the stripline conductors $56_1$, $56_2$, $58_1$, $58_2$ has a width W and a thickness $T_1$ which are related to provide an impedance of 50Ω for the striplines $56_1$, $56_2$, $58_1$, $58_2$. The distance $S_2$ between first striplines $56_1$, $58_1$ and between second striplines $56_2$ and $58_2$ ranges from approximately 0.01 to 0.05". This spacing $S_2$ is approximately an order of magnitude larger than the spacing between the first and second striplines in conventional contra-directional couplers. The length of the coupled sections of first and second striplines 56, 58 ranges from approximately 0.1 to 0.5 inches; the coupled sections are not required to be multiples of one-quarter wavelengths as in conventional couplers. The thickness $T_2$ of substrate 70 may range from approximately 0.002 to 0.015 inches.

A coupler in accordance with the present invention has coupling versus frequency characteristics which are greatly different than those of conventional contra-directional couplers. The coupling for a directional coupler in accordance with the present invention becomes tighter as the frequency of the signals increases, without an apparent drop-off in coupling. On the other hand, a conventional contra-directional coupler has a bell-shaped coupling curve with the peak of the curve usually falling in the center of the frequency range for which the coupler is designed.

The slope of the coupling versus frequency curve for coupler 50 of the present invention can be controlled by changing the spacing $S_2$ of striplines 56, 58 and the length L of the coupled section of striplines 56, 58. It has been experimentally determined that smaller spacings $S_2$ and shorter coupled section lengths L create a steeper coupling versus frequency curve, making a coupler which is useful for a narrower range of frequencies; however, the tradeoff for a steep coupling versus frequency curve is poorer directivity.

On the other hand, experimental results have determined that a longer coupling length L and a larger coupling spacing $S_2$ yield a coupler having a broader frequency response and a shallower coupling versus frequency curve. Longer coupling lengths L of the coupling region 57 yield improved directivity, but the increased length of striplines 56, 58 increases the losses which occur in coupler 50.

Figure 5A:
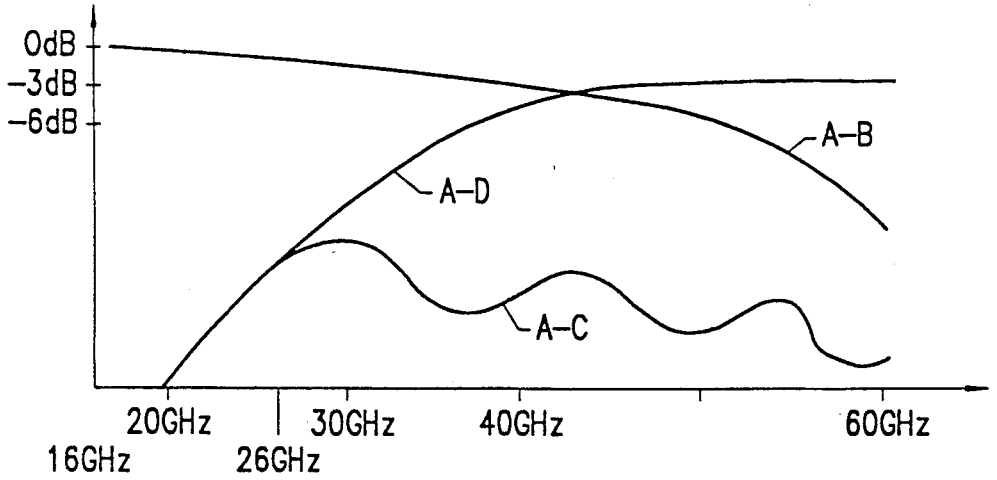
FIG. 5A-5C are graphs useful in explaining the operating characteristics of couplers in accordance with the present invention.

The inventor has determined that a coupler in accordance with the present invention which provides 3dB coupling at 40 GHz and tighter coupling at higher frequencies (with coupling as tight as 1dB at 60 GHz) can be fabricated utilizing a coupler having a ground plane spacing D of 0.045 inches, a dielectric having a thickness $T_2$ of 0.005 inches, parallel striplines 56, 58 having a spacing $S_2$ of 0.028 inches, and a coupling region 57 having a length L of 0.35 inches. The coupling versus frequency curve for a coupler having these dimensions is shown by curve A–D in FIG. 5A, which represents the coupling from port A to port D versus frequency. Curve A–B in FIG. 5A shows the losses for a signal transmitted from port A to port B, and curve A–C shows the directivity for this coupler. From FIG. 5A it can be seen that coupling of 3dB is achieved at 40 GHz, and that tighter coupling is achieved as frequency of the signal to be coupled increases from 40 to 60 GHz, and beyond.

Figure 5B:
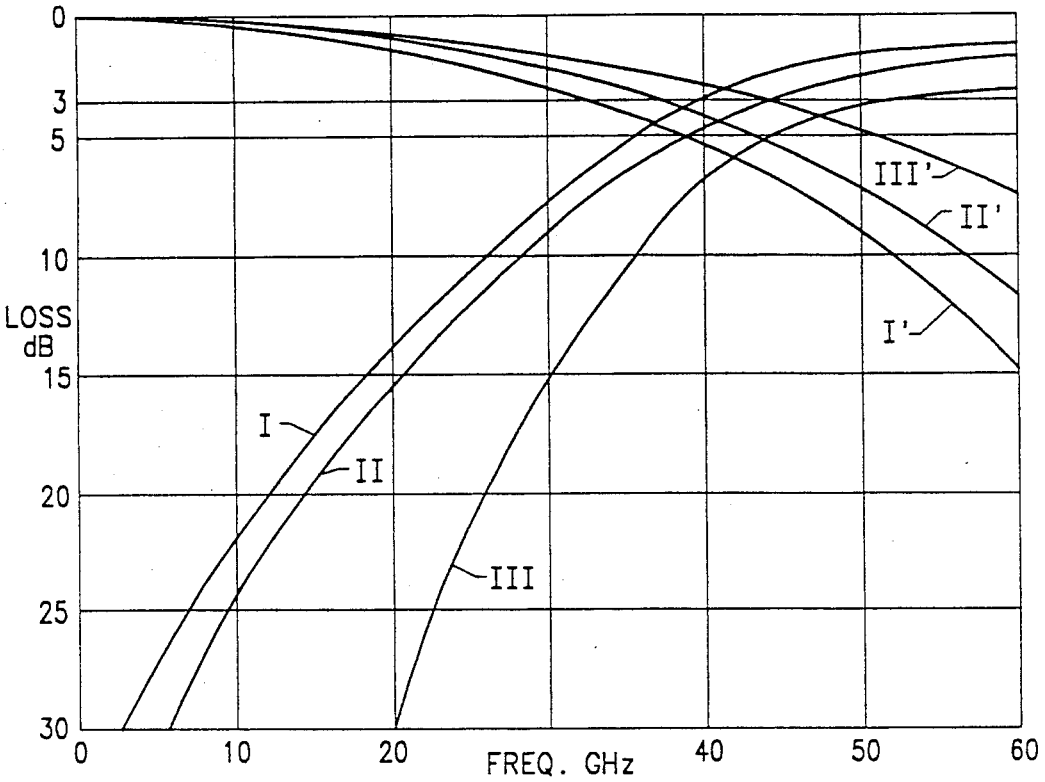
Figure 5C:
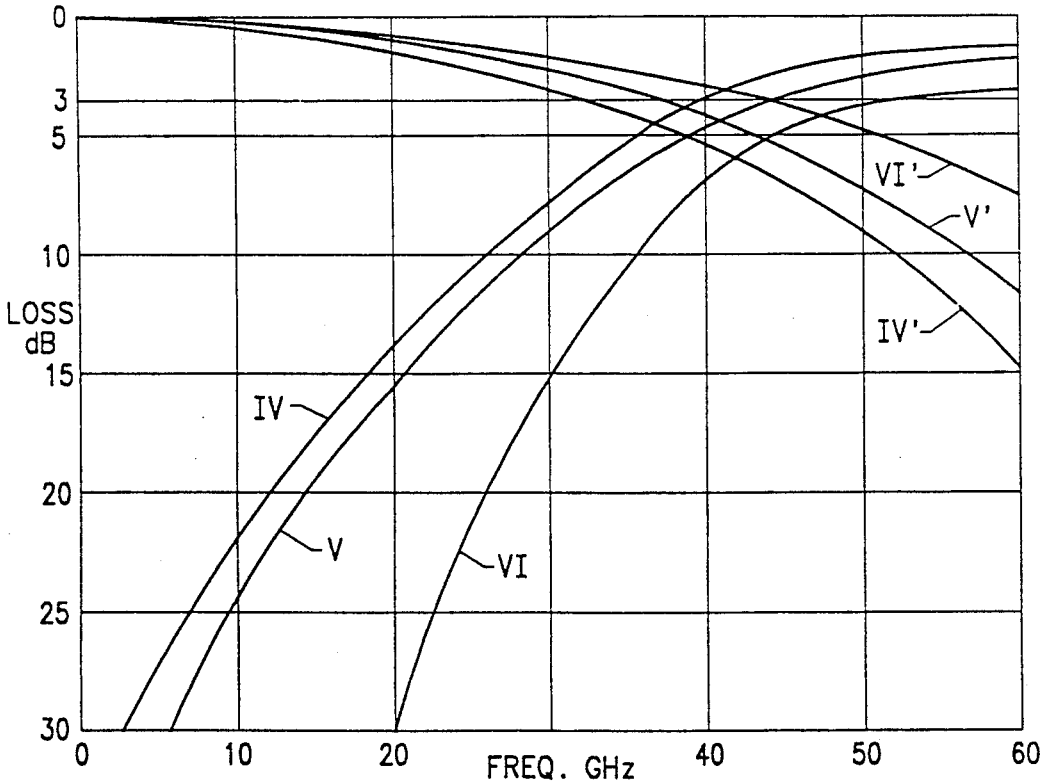

FIG. 5B illustrates the coupling characteristics for couplers having a coupling length L of 0.300", spacings $S_2$ of 0.028" (plot I), 0.035" (plot II), and 0.050" (plot III), and a substrate thickness of 0.010". The losses for signals transmitted from port A to port B are illustrated by plots I'–III', respectively. FIG. 5C illustrates the coupling characteristics for couplers having a coupling length L of 0.300", spacings $S_2$ of 0.020" (plot IV), 0.028" (plot V), and 0.036" (plot VI), and a substrate thickness of 0.005". The losses for signals transmitted from port A to port B are illustrated by plots IV'–VI', respectively.

Figure 6A:
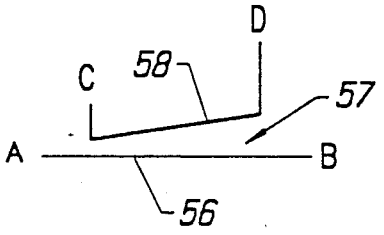
FIGS. 6A-6B are schematic diagrams of alternative embodiments of the present invention.
Figure 6B:
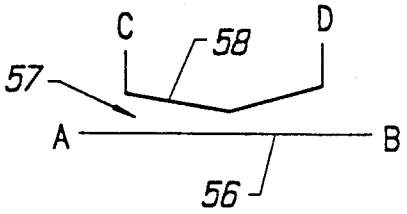

Parallel striplines 56, 58 in coupling region have been found to provide the best coupling. However, alternative arrangements of first and second striplines 56, 58 in the coupling region have been found to provide satisfactory coupling. Examples of alternatively arrangements for striplines 56, 58 are shown in FIGS. 6A and 6B. FIG. 6A illustrates a single tapered coupling region 57, and FIG. 6B illustrates a dual tapered coupling region 57.

Figure 7:
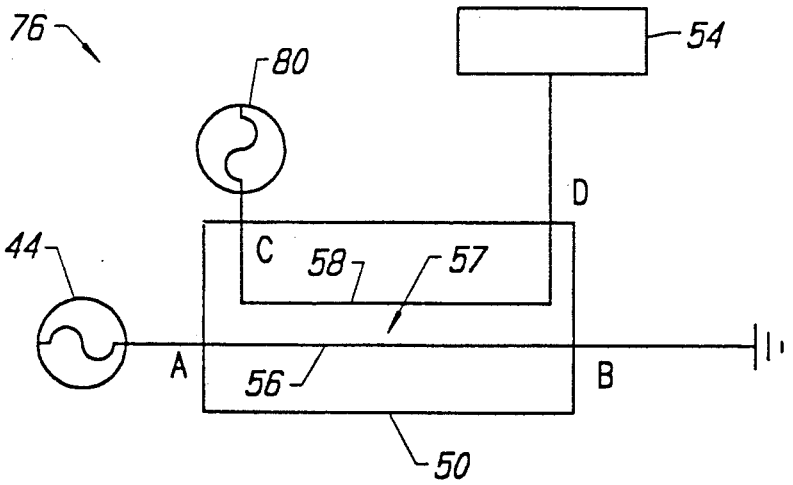
FIG. 7 is a schematic diagram useful in describing an application of the directional coupler of the present invention.

One example of an application for a coupler with the present invention is a multiplexer for signals having different frequencies. A multiplexer 76 utilizing a coupler 50 in accordance with the present invention is shown in FIG. 7. In multiplexer 76, signal source 44 provides signals having a frequency ranging from 40 to 60 GHz at port A of coupler 50, and signal source 80 provides signals having a frequency of 1–40 GHz at port C of coupler 50. The 40–60 GHz signals applied at port A are coupled to port D, and the 1–40 GHz signals applied at port C are transmitted to port D by second stripline 58. Accordingly, signals having frequencies of 1 to 60 GHz appear at port D and may be detected by test/measurement device 54.

The coupler of the present invention does not appear to operate with odd and even modes as does a conventional contra-directional coupler, and does not appear to operate as a TEM or quasi-TEM mode coupler, based on the fact that the coupling is not contra-directional. It is possible that the coupler operates in a waveguide coupling mode. However, the coupling mechanism is not presently known.

The many features and advantages of the present invention will be apparent to those skilled in the art from the Description of the Preferred Embodiments. Thus, the following claims are intended to cover all modifications and equivalents falling within the scope of the invention.

What is claimed is:

1. An apparatus for forward coupling signals comprising:

a first and a second transmission line, said first transmission line having at opposite ends thereof a port A and a port B, respectively, said second transmission line having at opposite ends thereof a port C and a port D, respectively, said ports A and C and said ports B and D being adjacent ports, respectively; and first and second tightly coupled suspended substrate forward coupling means realized by said first and said second transmission lines being in a generally side-by-side relationship a predetermined distance S apart between said ports A and B and between said ports C and D, respectively, such that a signal applied to said port A which has a frequency of at least 26GHz is forward coupled from said port A to said port D with a coupling factor of at least 8dB and substantially less coupling between said port A and port C.

2. An apparatus according to claim 1, wherein said first and said second forward coupling means comprises first and second suspended striplines in respective ones of said first and second transmission lines.

3. An apparatus according to claim 1, wherein said first and said second forward coupling means comprises:

first and second substantially parallel ground planes;

a dielectric layer support between said first and second ground planes, said dielectric layer having first and second opposed surfaces substantially parallel to respective ones of said first and second ground planes;

first and second suspended stripline conductors provided on respective ones of said opposed surfaces of said dielectric layer, said first and second suspended stripline conductors being electrically connected in parallel between said ports A and B of said first transmission line;

third and fourth stripline conductors provided on respective ones of said opposed surfaces of said dielectric layer, said third and fourth suspended stripline conductors being electrically connected in parallel between said ports C and D of said second transmission line, each of said third and fourth stripline conductors including a coupling section substantially parallel to and spaced said distance S from respective ones of said first and second stripline conductors.

4. An apparatus according to claim 3, wherein:

said coupling sections of said third and fourth stripline conductors have a length ranging from 0.1 to 0.5 inches and S ranges from 0.01 to 0.05 inches; and said substrate has a thickness measured between said opposed surfaces ranging from 0.002 to 0.015 inches.

5. An apparatus for forward coupling signals comprising:

a first and a second transmission line, said first transmission line having at opposite ends thereof a port A and a port B, respectively, and said second transmission line having at opposite ends thereof a port C and a port D, respectively, said ports A and C and said ports B and D being adjacent ports, respectively; and first and second suspended substrate tightly coupled forward coupling means are realized by said first and said second transmission lines, respectively, between said ports A and B and between said ports C and D, respectively, and which are spaced a predetermined distance S apart, such that a signal applied to said port A which has a frequency in the range of from 40 GHz to 60 GHz is forward coupled from said port A to said port D with substantially less coupling between said port A and port C.

6. An apparatus according to claim 5, wherein said first and said second suspended substrate forward coupling means comprises:

first and second substantially parallel ground planes;

a dielectric layer supported between said first and second ground planes, said dielectric layer having first and second opposed surfaces substantially parallel to respective ones of said first and second ground planes;

first and second suspended stripline conductors provided on respective ones of said opposed surfaces of said dielectric layer, said first and second suspended stripline conductors being electrically connected in parallel between said ports A and B of said first transmission line;

third and fourth stripline conductors provided on respective ones of said opposed surfaces of said dielectric layer, said third and fourth suspended stripline conductors being electrically connected in parallel between said ports C and D of said second transmission line, each of said third and fourth stripline conductors including a coupling section substantially parallel to and spaced said distance S from respective ones of said first and second stripline conductors.

7. An apparatus according to claim 6, wherein:

said coupling sections of said third and fourth stripline conductors have a length ranging from 0.1 to 0.5 inches and S ranges from 0.01 to 0.05 inches; and said substrate has a thickness measured between said opposed surfaces ranging from 0.002 to 0.015 inches.

8. A directional coupler, comprising:

first and second substantially parallel ground planes;

a dielectric layer supported between and spaced from said first and second ground planes, said dielectric layer having first and second opposed surfaces substantially parallel to respective ones of said first and second ground planes;

a first transmission line comprising first and second suspended stripline conductors provided on respective ones of said opposed surfaces of said dielectric layer;

a second transmission line comprising third and fourth stripline conductors provided on respective ones of said opposed surfaces of said dielectric layer, said second transmission line including a coupling section having a length L substantially parallel to and spaced a distance S from said first transmission line, said length L of said coupling section and said spacing S having preselected values to provide a preselected coupling coefficient versus frequency, so that microwave signals having a frequency of approximately 40–60GHz travelling on one of said first and second transmission lines are forward coupled to the other of said first and second transmission lines with a coupling factor of at least 3dB.

9. A directional coupler according to claim 8, wherein:

said first and second transmission lines have a uniform impedance of approximately 50Ω;

said coupling sections of said third and fourth stripline conductors have a length ranging from 0.1 to 0.5 inches and S ranges from 0.01 to 0.05 inches; and said substrate has a thickness measured between said opposed surface ranging from 0.002 to 0.015 inches.

10. An apparatus for directional coupling of signals, comprising:

first and second substantially parallel ground planes;

a dielectric layer supported between and spaced from said first and second ground planes, said dielectric layer having first and second opposed surfaces substantially parallel to respective ones of said first and second ground planes;

a first transmission line comprising first and second suspended stripline conductors provided on respective ones of said opposed surfaces of said dielectric layer;

a second transmission line comprising third and fourth stripline conductors provided on respective ones of said opposed surfaces of said dielectric layer, said third and fourth stripline conductors in said second transmission line including a coupling section having a length L which is substantially parallel to and spaced a distance S from said first transmission line, said first transmission line and said second transmission line including said coupling section each having a uniform impedance of approximately 50Ω and said length L of said coupling section and said spacing S having preselected values to provide a preselected coupling coefficient versus frequency, so that microwave signals having a frequency of approximately 40–60GHz applied to an input port of one of said first and second transmission lines are coupled to an opposite port of the other of said first and second transmission lines with a coupling factor of at least 3dB.

11. A directional coupler according to claim 10, wherein:

said coupling sections of said third and fourth stripline conductors have a length ranging from 0.1 to 0.5 inches and S ranges from 0.01 to 0.05 inches; and said substrate has a thickness measured between said opposed surfaces ranging from 0.002 to 0.015 inches.

12. A method of coupling microwave signals, comprising the steps of:

(a) providing first and second substantially parallel ground planes;

(b) providing a dielectric layer suspended between and spaced from the first and second ground planes, the dielectric layer having first and second opposed surfaces substantially parallel to respective ones of the first and second ground planes;

(c) providing a first transmission line comprising first and second stripline conductors provided on respective ones of the opposed surfaces of the dielectric layer;

(d) providing a second transmission line comprising third and fourth stripline conductors on respective ones of the opposed surfaces of the dielectric layer;

providing each of said third and fourth stripline conductors with a coupling section comprising a length ranging from 0.1 to 0.5 inches;

providing said first and second transmission lines with a first end and a second end;

designating the first ends of the first and second transmission lines as ports A and C, respectively;

designating the second ends of the first and second transmission lines as ports B and D, respectively;

(e) providing the coupling sections with a spacing of a distance S from respective ones of the first and second stripline conductors, where S ranges from 0.01 to 0.05 inches;

(f) providing microwave power to port A using microwave signals having a frequency greater than 26GHz; and (g) outputting the power received from port A at ports B and D such that the amount of said power transmitted to port D is at least approximately equal to the amount of said power transmitted to port B.

13. A method according to claim 12, further comprising the step of (h) isolating ports A and C from each other.

14. A method according to claim 12 further comprising the step of:

(h) outputting power at port C, wherein the amount of said power transmitted to port C is at least 6dB less than the amount of said power transmitted to said ports B and D.

15. A method according to claim 12, wherein said step (g) comprises outputting power at ports B and D wherein the amount of said power transmitted to port D is greater than the amount of said power transmitted to port B.

16. A method of operating a suspended substrate coupler to couple microwave signals in the forward direction, the coupler comprising first and second tightly coupled transmission lines having a coupling factor of at least 8dB, a first and a second end of the first transmission line being designated as ports A and B, respectively, and a first and a second end of the second transmission line being designated as ports C and D, respectively, ports A and C being at corresponding ends of the first and second transmission lines, comprising the steps of:

(a) applying microwave power to port A using a microwave signal having a frequency of at least 26GHz; and (b) outputting power at ports B and D such that the amount of said power transmitted to port D is at least approximately equal to the amount of power transmitted to port B.

17. A method according to claim 16, further comprising the step of:

(c) outputting power at port C, wherein the amount of said power transmitted to port C is at least 6dB less than the amount of said power transmitted to said ports B and D.

18. A method according to claim 16, wherein said step (b) comprises outputting power at ports B and D wherein the amount of said power transmitted to port D is greater than the amount of said power transmitted to port B.

19. A suspended substrate directional coupler for providing forward coupling of microwave signals having a frequency of at least 26GHz, comprising:

first and second substantially parallel ground planes;

a dielectric layer suspended between and spaced from said first and second ground planes, said dielectric layer having first and second opposed surfaces substantially parallel to respective ones of said first and second ground planes and a thickness measured between said opposed surfaces ranging from 0.002 to 0.015 inches;

a first transmission line comprising first and second stripline conductors provided on respective ones of said opposed surfaces of said dielectric layer; and a second transmission line comprising third and fourth stripline conductors provided on respective ones of said opposed surfaces of said dielectric layer, said second transmissions line having a coupling section substantially parallel with and spaced a distance S ranging from 0.01 to 0.05 inches from said first transmission line, said coupling sections of said third and fourth stripline conductors having a length ranging from 0.1 to 0.5 inches, said spacing S having preselected values to provide a preselected coupling coefficient versus frequency, so that microwave signals having a frequency of at least 26GHz applied to an input port of one of said first and second transmission are coupled to an opposite port of the other of said first and second transmission lines with a coupling factor of at least 3dB.

* * * * *

UNITED STATES PATENT AND TRADEMARK OFFICE

CERTIFICATE OF CORRECTION

PATENT NO. : 5,111,165

DATED : May 5, 1992

INVENTOR(S) : William W. Oldfield

It is certified that error appears in the above-identified patent and that said Letters Patent is hereby corrected as shown below:

Column 3, line 11, "3B" should be --3dB--.
Column 6, line 17, after "second" insert --surfaces--.
Column 8, line 36, "support" should be --supported--.
Column 10, line 16, "surface" should be --surfaces--.

Signed and Sealed this

Twentieth Day of July, 1993

*Attest:*

Michael K. Kirk

MICHAEL K. KIRK

*Attesting Officer*

*Acting Commissioner of Patents and Trademarks*